US008382390B2

(12) United States Patent
Cheng

(10) Patent No.: US 8,382,390 B2
(45) Date of Patent: Feb. 26, 2013

(54) QUICK COUPLING STRUCTURE OF LEG FOR TABLE OR CHAIR

(76) Inventor: Pao-Hsien Cheng, Tainan (TW)

( * ) Notice: Subject to any disclaimer, the term of this patent is extended or adjusted under 35 U.S.C. 154(b) by 37 days.

(21) Appl. No.: 12/915,581

(22) Filed: Oct. 29, 2010

(65) Prior Publication Data

US 2012/0104193 A1 May 3, 2012

(51) Int. Cl.
*B25G 3/10* (2006.01)

(52) U.S. Cl. ..... 403/378; 403/109.8; 403/322.4

(58) Field of Classification Search ..... 403/109.2, 403/109.3, 109.6, 109.8, 378, 305, 322.4, 403/325, DIG. 4; 297/463.1, 344.18, 440.15, 297/440.16, 440.24, 130, 244.12, 440.1
See application file for complete search history.

(56) References Cited

U.S. PATENT DOCUMENTS

| | | | | |
|---|---|---|---|---|
| 2,562,629 | A * | 7/1951 | Miles | 297/37 |
| 4,132,489 | A * | 1/1979 | Berg et al. | 403/305 |
| 4,586,399 | A * | 5/1986 | Kassai | 74/551.3 |
| 5,038,510 | A * | 8/1991 | Duke | 43/4 |
| 5,507,550 | A * | 4/1996 | Maloney | 297/153 |
| 5,536,063 | A * | 7/1996 | Cable | 297/16.2 |
| 6,293,623 | B1 * | 9/2001 | Kain et al. | 297/423.25 |
| 7,883,145 | B2 * | 2/2011 | Troutman et al. | 297/148 |
| 2003/0102700 | A1 * | 6/2003 | Lin | 297/183.9 |
| 2006/0250005 | A1 * | 11/2006 | Keegan et al. | 297/256.13 |
| 2011/0074186 | A1 * | 3/2011 | Zhong | 297/130 |
| 2011/0074187 | A1 * | 3/2011 | Zhong | 297/130 |

FOREIGN PATENT DOCUMENTS

GB 2459491 A * 10/2009

* cited by examiner

*Primary Examiner* — Joshua Kennedy
(74) *Attorney, Agent, or Firm* — Rosenberg, Klein & Lee

(57) ABSTRACT

A quick assembling structure of leg for table or chair, wherein connecting rods are provided with female formations respectively, and a coupling member having assembly cavities being provided into which the connecting rods can be inserted such that the ends of the connecting rods are pressed against the snap fasteners pivotally mounted in the assembly cavities, and that male blocks provided at the outside of the snap fasteners are engaged with the female formations provided on the connecting rods so as to firmly assemble the connecting rods and the coupling member together. When the connecting rods and the coupling member are to be detached, merely upwardly pull the connecting rods off from the coupling member to release the engagement between them so as to achieve quick assembly and disassembly.

6 Claims, 5 Drawing Sheets

QUICK COUPLING STRUCTURE OF LEG FOR TABLE OR CHAIR

BACKGROUND OF THE INVENTION

1. Field of the Invention

The present invention relates to a quick assembling structure of leg for table or chair, particularly to an assembly technology enabling quick and convenient attaching-detaching of leg for table or chair.

2. Brief Description of the Prior Art

Table and chair are indispensable furnitures in people's daily life. In conventional table or chair, legs are formed to be integral with table or chair and are made to be noncollapsible. Therefore, the whole volume of table or chair is bulky so that the quantities of table or chair carried by a truck for each delivery is quite limited. This results in higher transportation cost. Furthermore, when in storage, table or chair having bulky volume has to consume more space for warehousing so as to keep safety inventory. Again, this also causes soaring high of total operating cost. On the other hand, consumer buying the table or chair having legs integral therewith often suffers improper occupying with larger space in house due to incapability of disassembly.

Accordingly, concerning industry has proposed to divide the leg of table or chair into several segments, then screws and matching tapped holes are respectively provided on the segments to be connected for fastening and assembling therebetween so that the legs of table or chair can be detached during delivery, warehousing or storage so as to reduce the volume of table or chair. However, this structure using screws for fastening and assembling consumes much time and is not convenient and quick enough in assembly and disassembly process. In addition, the places using screws and tapped holes for assembling is easily worn after usage for a period of time such that the table or chair becomes not securely stable enough to avoid from shaking.

In view of the above disadvantages happened in the assembly structure of conventional table and chair, the inventor of the present invention hereby proposes a novel quick-assembling structure of leg for table or chair based on his contemplation in many ways and according to the assistance of his abundant knowledge and experience in product development and manufacturing in relevant field.

SUMMARY OF THE INVENTION

This invention relates to a leg quick-assembling structure, the main object of which is to provide an assembly technology enabling quick and convenient attaching-detaching of legs for table or chair.

In order to achieve above implementation object, the inventor proposes the following quick assembling structure of leg, which contains connecting rods, a coupling member and support legs with a number of usually four.

The connecting rods are respectively provided with female snap fastening formations on the bottom edge flanks thereof.

The coupling member is formed with assembly cavities into which the connecting rods can respectively inserted. Further, an opening portion is formed on one side of each assembly cavity in which a snap fastener is pivotally mounted. Each snap fastener is formed with an abutment face against which the bottom end of each connecting rod can abuts. Further, a male snap fastening block is provided in inclined manner to be connected and extended upward from the outside of the abutment face, which is engaged with the female snap fastening formation provided on the bottom edge of each connecting rod. Moreover, support legs are respectively assembled on the bottom ends of the connecting rods respectively.

Configuring like this, when in assembling, merely the connecting rods are inserted into the corresponding assembly cavities of the coupling member so that the snap fasteners pivotally mounted in the assembly cavities can be engaged in the female snap fastening formations of the connecting rods so as to achieve firm assembly between the connecting rods and the coupling member. When the connecting rods and the coupling member are to be detached, merely the connecting rods are pulled upward to be detached from the coupling member so that the engagement between the snap fasteners and the female snap fastening formations can be released to achieve the detachment therebetween. In this manner, convenient and quick assembly and disassembly effect can be achieved.

DETAILED DESCRIPTION OF PREFERRED EMBODIMENT

The objects, the technical contents and the expected effectiveness of the present invention will become more apparent from the detailed description of the preferred embodiment in conjunction with the accompanying drawings.

Figure 1:
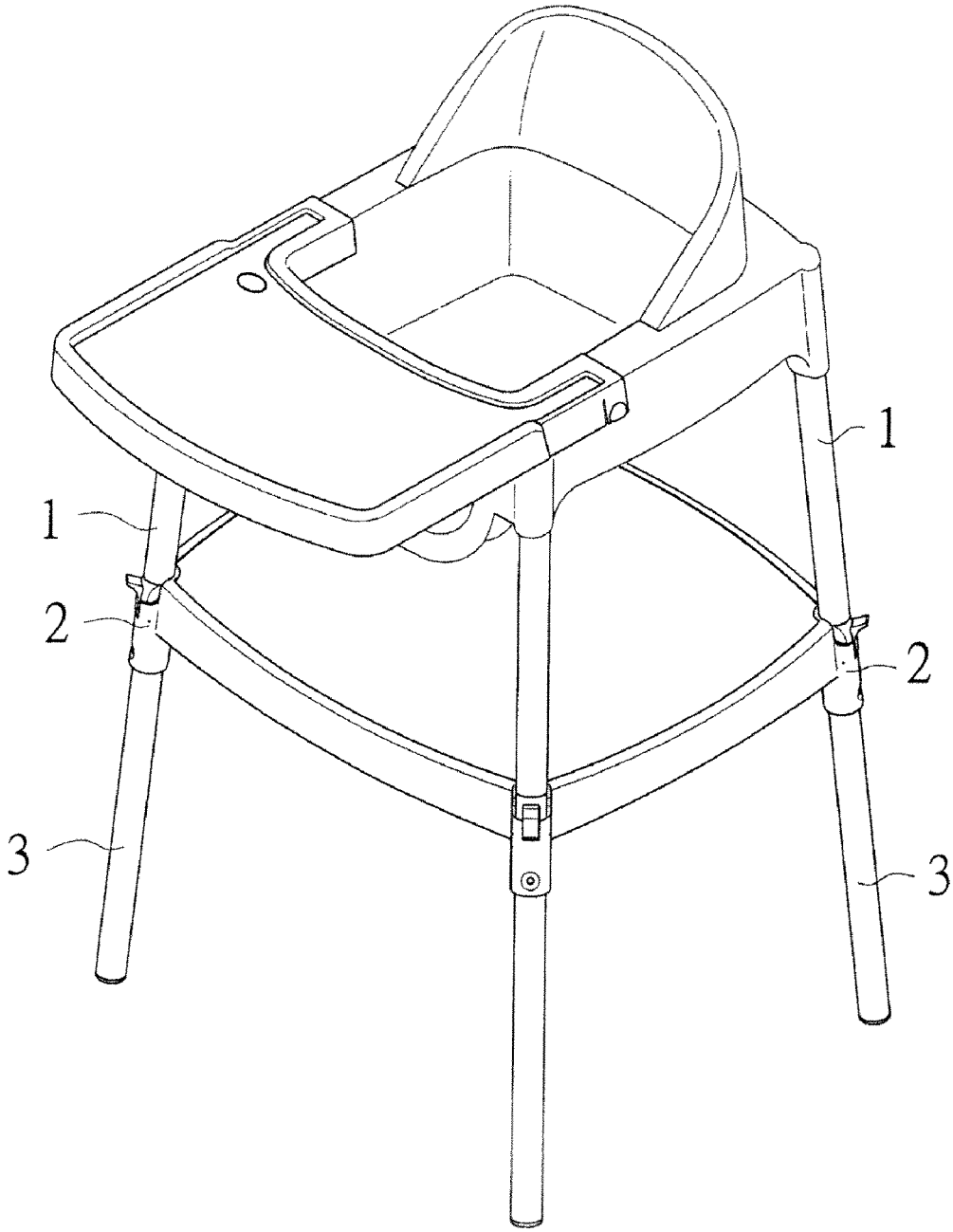
FIG. 1 is a perspective view showing the structure embodying the present invention.
Figure 2:
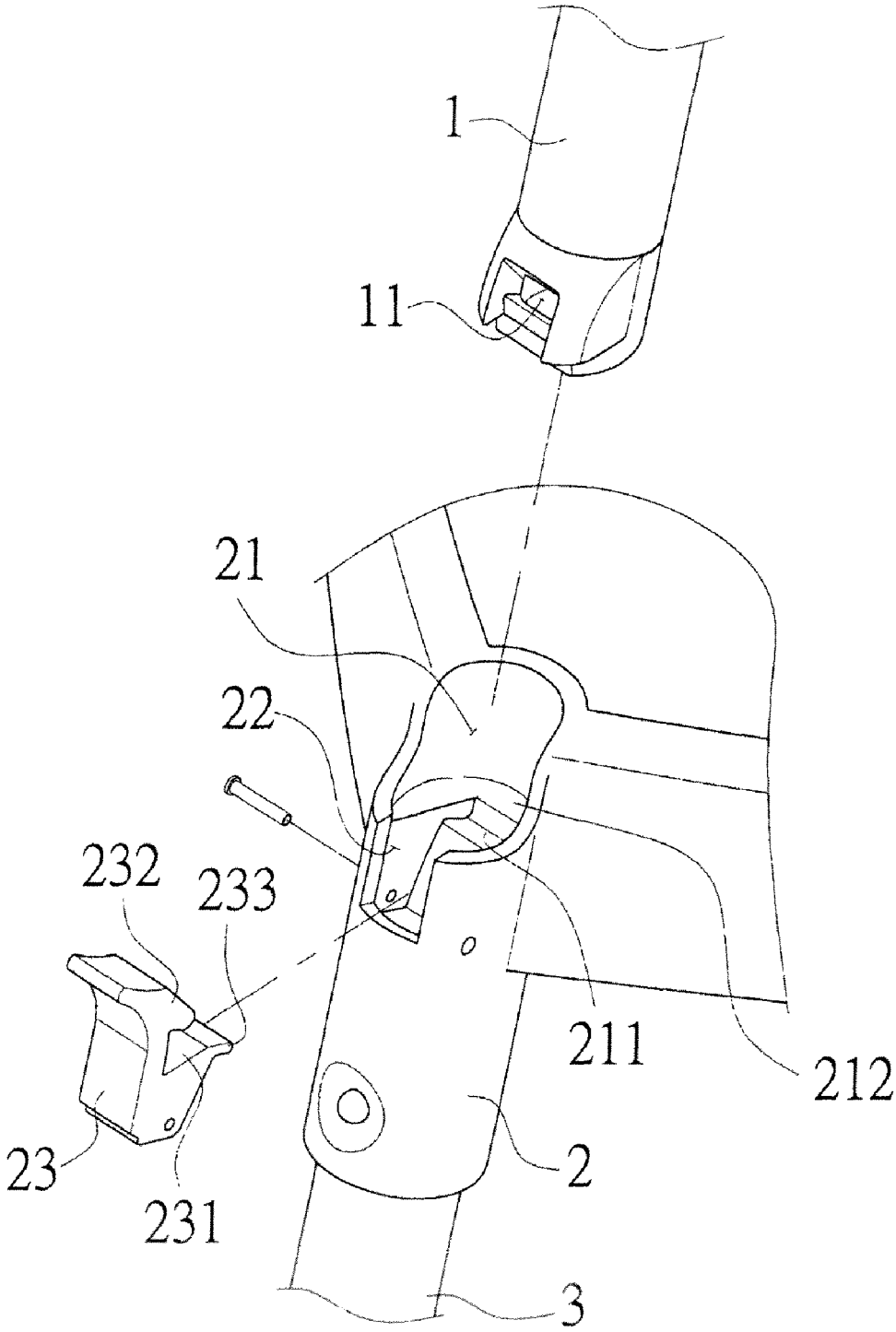
FIG. 2 is a perspective exploded view showing the structure of the present invention.

Firstly referring to FIGS. 1 and 2, the quick assembling structure of leg for table or chair of the present invention is essentially formed by connecting rods (1), a coupling member (2) and support legs (3) with a number of usually four.

The connecting rods (1) are provided with female snap fastening formations (11) respectively on the bottom edge flanks thereof.

The coupling member (2) is formed with assembly cavities (21) into which the connecting rods (1) can be inserted. Further, an opening portion (22) is formed respectively on one side of each assembly cavity (21) in which a snap fastener (23) is pivotally mounted. Each snap fastener (23) is formed with an abutment face (231) against which the bottom end of each connecting rod (1) can abuts. Further, a male snap fastening block (232) is provided in inclined manner to be connected and extended upward from the outside of the abutment face (231), which is engaged with the female snap fastening formation (11) provided on the bottom edge of each connecting rod (1). Furthermore, a stop edge (233) is provided on the inside of the abutment face (231) of each snap fastener (23), which abuts against a positioning protruding edge (211) provided at the inside of a step in each assembly cavity (21). Moreover, an abutment flange (212) is provided on the upper side of positioning protruding edge (211) within each assembly cavity (21), which is for abutting with the bottom end edge of each connecting rod (1).

Figure 3:
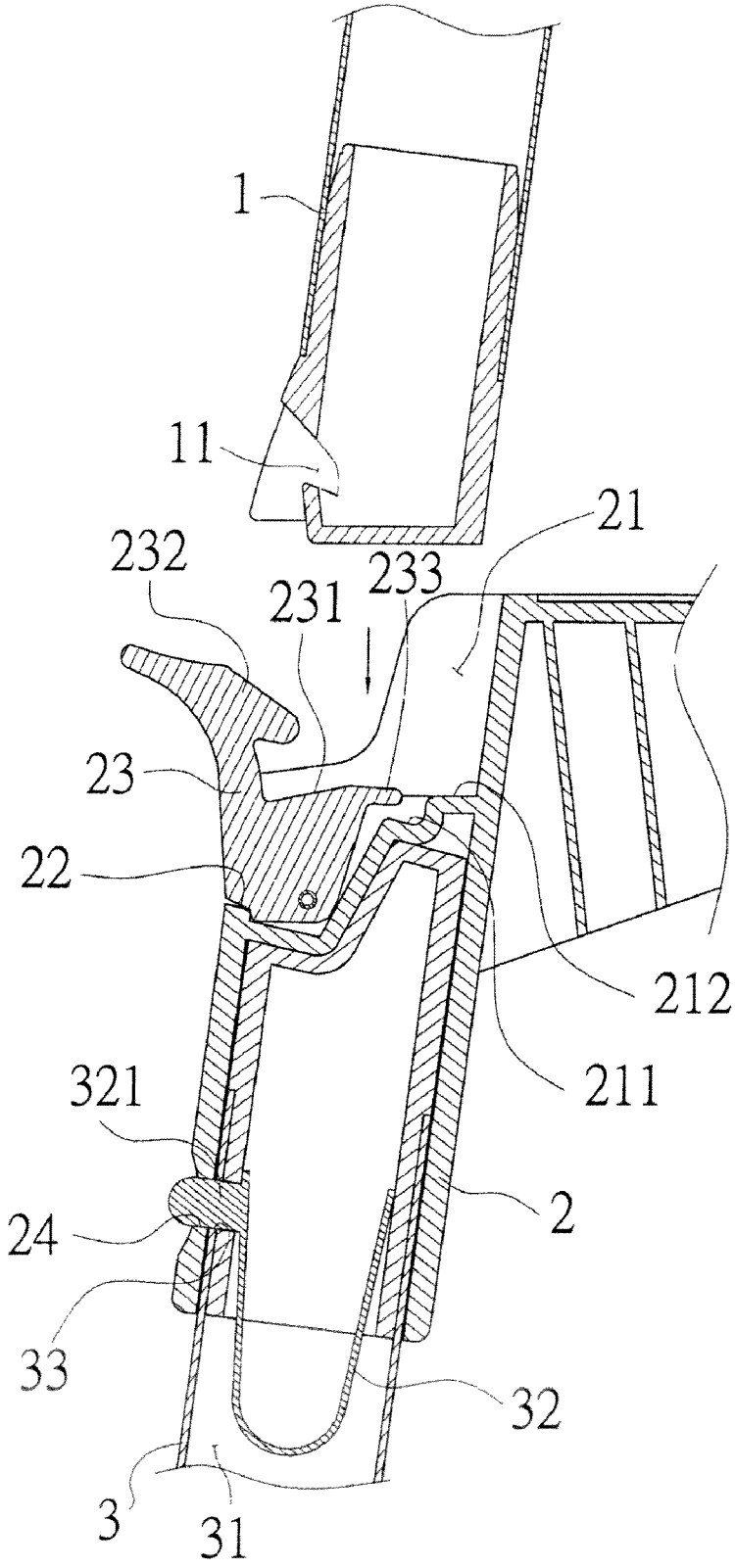
FIG. 3 is a view showing the state of implementing the assembly of the present invention.

Referring to FIG. 3, support legs (3) are assembled on the bottom ends of the coupling member (2). In more detailed explanation, perforations (24) are provided on the flanks near the bottom of the coupling member (2). A spring piece (32) is accommodated within a hollow portion (31) of each support leg (3). Each spring piece (32) has a bump (321) provided thereon and the bump (321) is penetrated through a perforation (33) provided on each support leg (3) to protrude to the outside of each support leg (3) so as to be in snap-fit with the perforation (24) of the coupling member (2).

Figure 4:
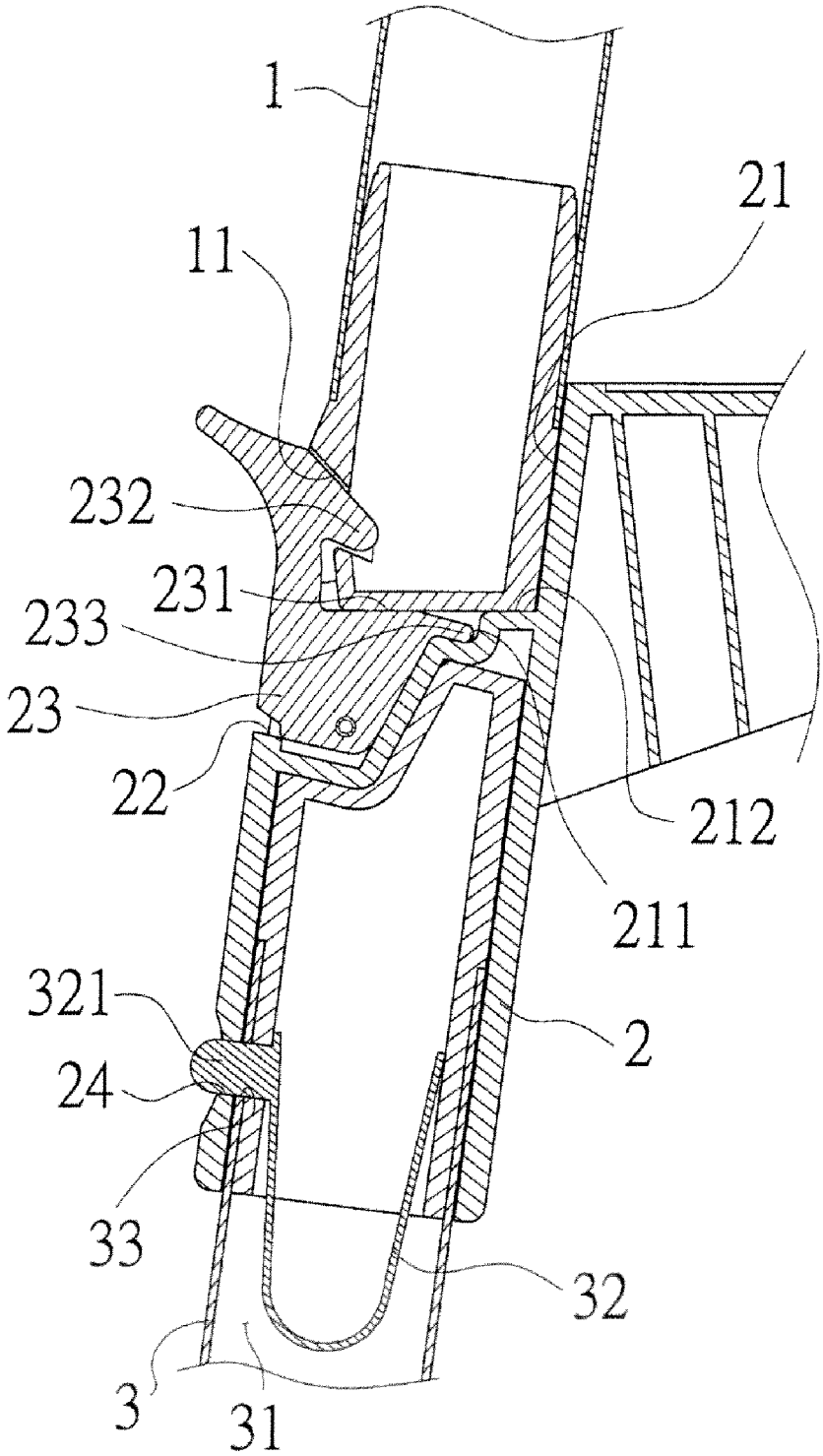
FIG. 4 is a view showing the fixed state after assembly of the present invention.

Configuring like this, referring to FIG. 4, when in assembling and to usage, the connecting rods (1) are inserted respectively into the assembly cavities (21). At this moment, one side edge on the bottom end of each connecting rod (1) abuts firstly against the abutment flange (212) located at the inner side of the assembly cavity (21), so that a vertical positive pressure can be maintained on the other side at the bottom end of the connecting rod (1) to press against the abutment face (231) of the snap fastener (23) pivotally mounted in the assembly cavity (21). In the meantime, the vertical positive pressure pressing against the abutment face (231) of the snap fastener (23) produces a component force tilted to the inside of the assembly cavity (21) to draw the male snap fastening block (232) provided in tilting manner at the outside of the snap fastener (23) into engagement with the female snap fastening formation (11) provided on the bottom edge of each connecting rod (1), so that the connecting rod (1) is assembled to the coupling member (2). Furthermore, the vertical positive pressure pressing against the abutment face (231) of the snap fastener (23) also produces a component force tilted downwardly to force the stop edge (233) provided at the inside of each snap fastener (23) to abut against the positioning protruding edge (211) provided at the inside of each assembly cavity (21) for positioning. In this way, the steadiness of engagement between the snap fasteners (23) and the connecting rods (1) is further enhanced. Moreover, as the connecting rods (1) of table or chair legs bears against weight force pressing downward when a user applies a force on the table or chair, the male snap fastening blocks (232) of the snap fasteners (23) can engaged more tightly in the female snap fastening formations (11) so as to firmly assemble the connecting rods (1) and the coupling member (2) together.

Figure 5:
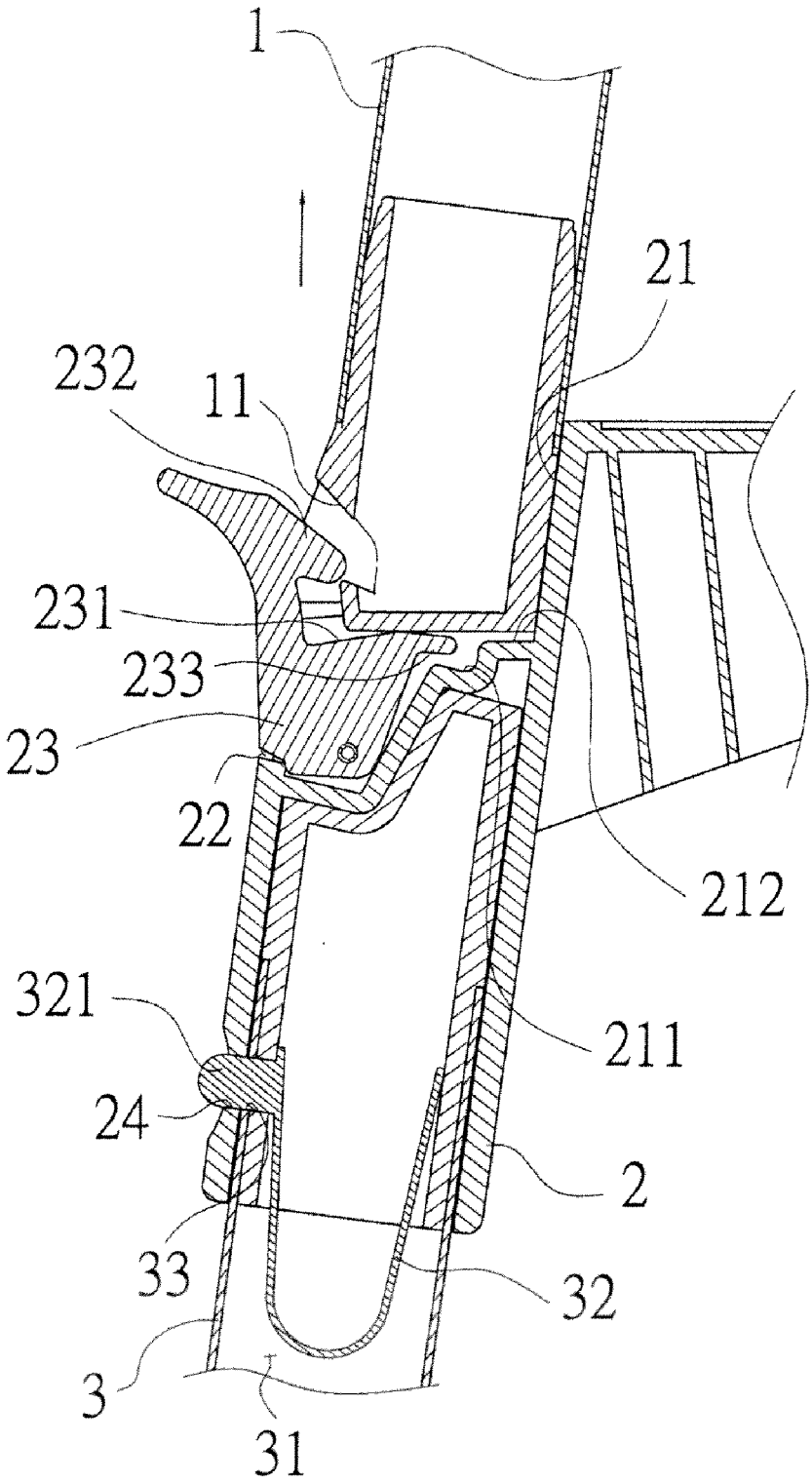
FIG. 5 is a view showing the state of implementing disassembly of the present invention.

Furthermore, referring to FIG. 5, when the connecting rods (1) is to be detached from the coupling member (2) so as to facilitate transportation or storage, an upward force is applied to each connecting rod so that the connecting rods (1) can release the pressing against the abutment face (231) of the snap fastener (23) of the coupling member (2). At this moment, the drawing force applied on the snap fastener (23) by the male snap fastening block (232) due to the pressing of the connecting rod (1) against the abutment face (231) of the snap fastener (23) can be removed. In the meantime, the force produced by the pressing of the stop edge (233) of the snap fastener (23) against the positioning protruding edge (211) of the assembly cavity (21) also can be released. In this manner, by continuously applying upward force on the connecting rod (1), the male snap fastening block (232) of the snap fastener (23) engaged in the female snap fastening formation (11) of each connecting rod (1) slides out of the same so as to be removed from the engagement therewith. Hence, the connecting rods (1) can be detached from the coupling member (2). In this way, convenient and quick assembly and disassembly effect can be achieved.

Based on the above structure and implementation mode, the quick assembling structure of leg for table or chair of the present invention apparently has the following advantages.

1. In the present invention, the quick assembling structure of leg for table or chair is essentially has snap fasteners respectively provided in the assembly cavities of the coupling member, and abutment faces are respectively formed on the snap fasteners. When each connecting rod is inserted in corresponding assembly cavity, the connecting rod presses downward positively against the abutment face and produces a component force to draw the male snap fastening block provided at the outside of the snap fastener into engagement with the female snap fastening formation provided on each connecting rod. Moreover, as each connecting rod bears against weight force pressing downward when a user applies a force on the table or chair, the male snap fastening block can engaged more firmly in the corresponding female snap fastening formation so as to maintain the table or chair in steady state when in usage.

2. In the present invention, the quick assembling structure of leg for table or chair is essentially has snap fasteners provided respectively in the assembly cavities of the coupling member, and abutment faces are respectively formed on the snap fasteners so that the connecting rods press downward onto the abutment faces upon the insertion into the assembly cavities. Configuring like this, besides a drawing force is generated to draw the male snap fastening block provided at the outside of the snap fastener into engagement with the female snap fastening formation provided on each connecting rod, a component force tilted downwardly is also produced to force the stop edge provided at the inside of each snap fastener to abut against the positioning protruding edge provided at the inside of each assembly cavity for positioning. In this way, the steadiness of the snap fasteners can be ensured so as to make the engagement between the connecting rods and the coupling member become more stable.

3. In the quick assembling structure of leg for table or chair of the present invention, merely the connecting rods are inserted into the corresponding assembly cavities of the coupling member so that the snap fasteners pivotally mounted in the assembly cavities can be engaged in the female snap fastening formations so as to achieve securely assembly between the connecting rods and the coupling member, when in assembling. When the connecting rods and the coupling member are to be detached, merely the connecting rods are pulled upward to be detached from the coupling member so that the engagement between the snap fasteners and the female snap fastening formations can be released so as to achieve the detachment therebetween. In this manner, convenient and quick assembly and disassembly effect can be achieved.

What is claimed is:

1. A quick assembling structure of legs for table or chair, comprising:

a plurality of longitudinally extended connecting rods (1) each provided with a female snap fastening formation (11) on a bottom edge thereof;

a plurality of coupling members (2) each having an assembly cavity (21) formed thereon and an abutment flange extending into said assembly cavity, each of the connecting rods (1) being inserted in said assembly cavity and stopped against said abutment flange of one said coupling member; and, a plurality of snap fasteners (23) each pivotally mounted in one said assembly cavity (21), each said snap fastener defining an abutment face (231) and a male snap fastening blocks (232) offset therefrom extending in tilting manner;

wherein said snap fastening block is angularly biased to engage said female snap fastening formation (11) provided on a bottom edge of said connecting rod (1) responsive to a bottom end of said connecting rod pressing longitudinally against said abutment face when inserted in said assembly cavity.

2. The quick assembling structure of legs for table or chair as claimed in claim 1, wherein a positioning protruding edge (211) is provided within each of said assembly cavities (21) of said coupling members (2); and a stop edge (233) is provided on each of said abutment faces (231) of said snap fasteners (23) to engage a corresponding one of said positioning protruding edges (211) of said assembly cavities (21).

3. The quick assembling structure of legs for table or chair as claimed in claim 2, wherein each of said abutment flanges (212), extends in stepped manner from said positioning protruding edge (211) within said assembly cavity (21) of one said coupling member (2).

4. The quick assembling structure of legs for table or chair as claimed in claim 3, wherein a plurality of support legs (3) are respectively assembled on bottom ends of said coupling members (2), a perforation (24) being formed in each said coupling member (2); and, a spring piece (32) accommodated within a hollow portion (31) of each said support leg (3), each said spring piece (32) having a bump (321) passing through a perforation (33) provided on said support leg (3) to be in snap-fit engagement with said perforation (24) of said coupling member (2).

5. The quick assembling structure of legs for table or chair as claimed in claim 1, wherein each of said abutment flanges (212) extends in stepped manner from said positioning protruding edge (211) within said assembly cavity (21) of one said coupling member (2).

6. The quick assembling structure of legs for table or chair as claimed in claim 1, wherein a plurality of support legs (3) are respectively assembled on bottom ends of said coupling members (2), a perforation (24) being formed in each said coupling member (2); and, a spring piece (32) accommodated within a hollow portion (31) of each said support leg (3), each said spring piece (32) having a bump (321) passing through a perforation (33) provided on said support leg (3) to be in snap-fit engagement with said perforation (24) of said coupling member (2).

* * * * *